US007526223B2

(12) United States Patent
Adachi et al.

(10) Patent No.: US 7,526,223 B2
(45) Date of Patent: Apr. 28, 2009

(54) HEAT EXHAUSTING STRUCTURE AND IMAGE FORMING APPARATUS

(75) Inventors: Takefumi Adachi, Tokyo (JP); Kazuhiko Imamura, Tokyo (JP); Masaaki Tsuda, Tokyo (JP); Toshio Ishii, Tokyo (JP); Makoto Ando, Tokyo (JP); Yuichi Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 389 days.

(21) Appl. No.: 11/414,176

(22) Filed: May 1, 2006

(65) Prior Publication Data

US 2006/0257161 A1 Nov. 16, 2006

(30) Foreign Application Priority Data

May 10, 2005 (JP) ..... 2005-137398
May 31, 2005 (JP) ..... 2005-160461

(51) Int. Cl.
*G03G 21/00* (2006.01)

(52) U.S. Cl. ..... 399/92

(58) Field of Classification Search ..... 399/91–93
See application file for complete search history.

(56) References Cited

U.S. PATENT DOCUMENTS 3,901,591 A * 8/1975 Mitsumasu ..... 399/92
5,166,727 A * 11/1992 Miyamoto et al. ..... 399/92
5,185,629 A * 2/1993 Iino et al. ..... 399/93
5,424,806 A * 6/1995 Siegel ..... 399/92
6,259,871 B1 * 7/2001 Rider et al. ..... 399/92
6,308,024 B1 * 10/2001 Nakayama et al. ..... 399/92
6,792,226 B2 * 9/2004 Chikano ..... 399/92
6,825,872 B2 * 11/2004 Chikano
7,024,129 B2 4/2006 Adachi (Continued)

FOREIGN PATENT DOCUMENTS

JP 02266386 A * 10/1990

(Continued)

OTHER PUBLICATIONS

Yasuda et al., Heat fixing apparatus for use in image forming device, has cleaning roller to remove toner adhered to heating roller and air blower to blow outer air against cleaning roller for cooling cleaning roller, Jul. 15, 2004, Derwent Information LTD abstract.*

(Continued)

*Primary Examiner*—Susan S Lee
(74) *Attorney, Agent, or Firm*—Oblon, Spivak, McClelland, Maier & Neustadt, P.C.

(57) ABSTRACT

A housing in which a heat source for heating a member to be heated is disposable includes a first end and a second end in a longitudinal direction. Each of the first end and the second end is linked to a duct. A blowing unit is provided at the first end of the housing and causes an airflow in a space formed in a state in which the heat source is disposed in the housing. The duct linked to the second end of the housing is formed to extend from the second end. A length of the duct linked to the second end of the housing is longer than a hydraulic diameter by a predetermined number of times or more.

18 Claims, 15 Drawing Sheets

U.S. PATENT DOCUMENTS

| | | | | |
|---|---|---|---|---|
| 7,079,785 | B2 * | 7/2006 | Koshimura et al. | |
| 7,400,842 | B2 * | 7/2008 | Takehara et al. | 399/92 |
| 2004/0228647 | A1 * | 11/2004 | Kida | 399/92 |
| 2005/0089315 | A1 | 4/2005 | Imamura et al. | |
| 2005/0231821 | A1 | 10/2005 | Tsuda et al. | |

FOREIGN PATENT DOCUMENTS

| | | | | |
|---|---|---|---|---|
| JP | 04344682 | A | * | 12/1992 |
| JP | 2554613 | | | 7/1997 |
| JP | 11-231760 | | | 8/1999 |
| JP | 2000-98857 | | | 4/2000 |
| JP | 2000267495 | A | * | 9/2000 |
| JP | 2001-22151 | | | 1/2001 |
| JP | 2003-202728 | | | 7/2003 |
| JP | 2003186323 | A | * | 7/2003 |
| JP | 2003-316107 | | | 11/2003 |
| JP | 2004198749 | A | * | 7/2004 |

OTHER PUBLICATIONS

Ministry of Posts and Telecommunication, et al, "Ministry Ordinance to Amend Part of Regulations for Enforcement of the Radio Law", Document No. 4, Jul. 14, 2000, 4 pages ( with English Translation).

* cited by examiner

FIG.6

| AIR VOLUME ($m^3$/min) | OUTLET AIRFLOW TEMPERATURE (°C) | ALLOWABLE TEMPERATURE (°C) | AMBIENT TEMPERATURE (°C) |
|---|---|---|---|
| 0.01 | 386.0 | 150.0 | 32.0 |
| 0.02 | 209.0 | 150.0 | 32.0 |
| 0.03 | 150.0 | 150.0 | 32.0 |
| 0.04 | 120.5 | 150.0 | 32.0 |
| 0.05 | 102.8 | 150.0 | 32.0 |
| 0.06 | 91.0 | 150.0 | 32.0 |
| 0.07 | 82.6 | 150.0 | 32.0 |
| 0.08 | 76.3 | 150.0 | 32.0 |
| 0.09 | 71.3 | 150.0 | 32.0 |
| 0.10 | 67.4 | 150.0 | 32.0 |
| 0.11 | 64.2 | 150.0 | 32.0 |
| 0.12 | 61.5 | 150.0 | 32.0 |
| 0.13 | 59.2 | 150.0 | 32.0 |
| 0.14 | 57.3 | 150.0 | 32.0 |
| 0.15 | 55.6 | 150.0 | 32.0 |

HEAT EXHAUSTING STRUCTURE AND IMAGE FORMING APPARATUS

CROSS-REFERENCE TO RELATED APPLICATIONS

The present document incorporates-by reference the entire contents of Japanese priority document, 2005-137398 filed in Japan on May 10, 2005 and 2005-160461 filed in Japan on May 31, 2005.

BACKGROUND OF THE INVENTION

1. Field of the Invention

The present invention relates to a heat exhausting structure and an image forming apparatus, and more particularly, to a heat exhausting structure used in a fixing unit provided in an image forming apparatus.

2. Description of the Related Art

An electrophotographic system is well known as an image forming system. In the electrophotographic system, when an electrostatic latent image formed on a photosensitive member equivalent to a latent image carrier is visualized according to supply of a toner from a developing device, a toner image is transferred onto a recording medium like a recording sheet. The toner image transferred is fixed on the recording medium by melting and permeation actions using heat and pressure in a fixing unit.

The fixing unit heats a recording sheet and fixes an image thereon while holding and conveying the recording sheet using a fixing roller including an internal heat source and a pressure roller. Alternatively, the fixing unit uses a belt wound around rollers to convey a recording sheet. In the belt, unlike the rollers and the like, it is possible to reduce a heat capacity.

When the surface of the belt is heated from the outside rather than the inside of the rollers, it is possible to quicken the rise of a surface temperature of the belt that is in contact with an unfixed toner. In the technology described in "Addition of a Document Copying and Printing Machine using Electromagnetic Induction Heating to the Format Designation" (a material concerning consultation with the Radio Regulatory Council about an amendment of the Radio Law Enforcement Regulations) announced by the Postal Services Agency of the Ministry of Internal Affairs and Communications on Jul. 14, 2000, it is possible to use the electromagnetic induction system as an external heating source.

As devices serving as heat generating sources in the image forming apparatus such as the fixing unit, the image forming apparatus also includes electromagnetic devices like a motor and a clutch and a micro chip or the like used for control. However, in particular, heat from the fixing unit having a large heat capacity may cause an increase in an ambient temperature in the image forming apparatus and exert thermally adverse effect on the devices provided in the image forming apparatus.

For example, since a toner is used as a developer in the developing device, it is likely that coagulation of the toner is caused by a temperature rise in the developing device to make it impossible to perform desired developer supply control. In an optical system, lenses made of resin are often used as optical lenses like an fθ lens. Thus, a regular imaging optical path may change because of thermal deformation or the like to cause a writing failure from which abnormality of an image like color drift occurs.

Thus, conventionally; technologies for discharging heat generated in a fixing unit to the outside are adopted. As an example, in a first conventional technology (Japanese Patent Application Laid-Open No. H11-231760), in general, a heat exhaust fan is arranged near a fixing unit.

In a second conventional technology (Japanese Patent Application Laid-Open No. 2000-98857), an airflow path using a duct is formed between a position near a fixing unit and an outer wall of an image forming apparatus body, a fan is provided on an entrance side of the airflow path, and a cutout, from which the air from the position near the fixing unit can be led in, is formed in a part of the duct to make it possible to lead the hot air in the position near the fixing unit into the duct.

In a third conventional technology (Japanese Patent Application Laid-Open No. 2001-22151), to prevent thermal deformation of optical components, it is proposed to provide a duct that makes it possible to collectively arrange respective optical devices in an airflow path to isolate and radiate heat using the duct.

On the other hand, in a fourth conventional technology (Japanese Patent Application Laid-Open No. 2003-316107), to prevent heat generated in a fixing unit from spreading to a section around the fixing unit, when the fixing unit is arranged near a position where a toner supply tank used for a toner supply unit is set, a heat insulation member is provided between the toner supply tank and the fixing unit or a ventilating unit is provided in addition to the heat insulation member.

In a fifth conventional technology (Japanese Patent Application Laid-Open No 2003-202728), a toner supply tank and a fixing unit are spaced apart from each other.

In recent years, it is desired to reduce time required for staring an image forming apparatus. It is also desired to reduce time for warming-up required for raising temperature of a fixing unit to a predetermined fixing temperature.

Therefore, a heating system for quickly raising temperature to a heating temperature is used in addition to the belt having a small heat capacity. As an example of this heating system, there is the electromagnetic induction heating (IH) system.

In the electromagnetic induction heating system, a metal housing including a magnetic force generating coil is arranged near the surface of the belt to make it possible to heat the belt with radiation heat from the metal housing side that is generated using an eddy current caused by a magnetic line of force transmitted through the metal housing.

However, problems described below occur when the electromagnetic induction heating system is used.

When the belt is heated from the metal housing side near the belt surface, heat retention on a roller side is smaller than heat retention at the time when a heating source for heating the belt is provided on the roller side. Therefore, since heat from the metal housing used for electromagnetic induction heating easily spreads to a section around the metal housing, a temperature rise in a space around the metal housing is caused. As a result, as described above, the heat adversely affects the optical system and the developing device.

On the other hand, insulation performance of the magnetic force generating coil used for electromagnetic induction heating changes according to a temperature rise. The magnetic force generating coil may cause an insulation failure depending on temperature. Thus, it is conceivable to perform heat radiation by airflow as disclosed in the patent documents to prevent a temperature rise in the section around the metal housing and an overheated state of the magnetic force generating coil.

When the airflow is used, a flow rate only has to be increased according to a size of a heat radiation range. However, since an electric current fed to the magnetic force generating coil and a heat value are in a square root relation, to obtain a heat value for reducing a rising edge of warming-up, an electric current suitable for obtaining the heat value is fed. Accordingly, a flow rate of a cooling airflow for controlling the influence of heat on the section around the metal housing has to be increased. As a result, when the flow rate of the cooling airflow is increased, an airflow sound and a driving sound of a fan tend to increase. It is likely that a new problem of environmental noise occurs. In particular, in the inside of the metal housing including the magnetic force generating coil, since a large number of components including not only coils but also structural components like a ferrite are highly densely arranged, a space through which the airflow passes may be small. Consequently, a flow rate of the cooling airflow is secured and a flow velocity for securing this flow rate is increased. Thus, it is likely that noise is noticeably caused.

However, image forming apparatuses in recent years tend to be reduced in size. Therefore, a packaging density of devices in an image forming apparatus is increased. When forced heat exhaust is performed using a fan, there is a problem of airflow in the image forming apparatus as disclosed in the patent document. In other words, simply by setting a suction fan on a wall of the image forming apparatus, airflow for efficient heat exhaust is not caused in some cases. Therefore, there is a deficiency in that the image forming apparatus is filled with heat or ozone cannot be satisfactorily discharged.

As measures against an abnormal temperature rise in the image forming apparatus, there is heat exhaust by airflow generation using a fan or the like. To increase heat exhaust efficiency, it is important to increase a quantity of the air and a velocity (a pressure) of the airflow from the fan and quickly discharge the overheated air to the outside. However, a problem described below occurs when such measures are adopted.

In the image forming apparatus, since writing of an image on a photosensitive member and visualization of an electrostatic latent image formed by the writing are continuously performed, a writing device and a developing device may be arranged relatively close to each other.

Therefore, when a quantity of the air and a velocity of the airflow from the fan are increased, a toner simply adhering to a recording sheet electrostatically at a stage before fixing may be blown off. The toner scattered in the image forming apparatus may enter the writing device. Consequently, since the toner entering the writing apparatus adheres to and soils the optical components, it is likely that an abnormal situation like lack of a part of a written image occurs and an image with a writing failure is obtained.

Thus, in the first conventional technology, to solve the deficiency, the number of fans is increased, a duct having a special structure is provided to form an exhaust flow path, or a plurality of stages of filters is provided.

However, when such a constitution is adopted, it is necessary to collectively arrange respective optical writing devices in the duct used as heat prevention measures for the optical components. Thus, a size of the duct is increased and the duct is required to be arranged not to hinder airflow. As a result, a space for setting components in the image forming apparatus is required. It is likely that a size of the image forming apparatus is increased because of the increase in the space for setting the image forming apparatus.

On the other hand, in the fourth conventional technology, a space for setting the heat insulation member and the ventilating unit in the small space in the image forming apparatus is required. Similarly, in the fifth embodiment, it is necessary to set a relatively large space to prevent heat of the fixing apparatus from affecting the position where the toner supply tank is set. Therefore, the problem concerning the setting space in the image forming apparatus is left unsolved.

When discharge of the air in the image forming apparatus is facilitated to improve heat exhaust efficiency by increasing places where the airflow is generated in the image forming apparatus through addition of the fans, it is likely that an increase in size of the image forming apparatus is caused by an increase in component cost due to the addition of the fans and an increase in the setting space. Moreover, it is likely that driving noise and airflow sounds from the fans are caused more frequently. In particular, when the electromagnetic induction heating system is used as the heating system of the fixing unit, it is likely that noise is caused more noticeably because of a reason described below.

The insulation performance of the magnetic force generating coil used for electromagnetic induction heating changes according to a temperature rise. The magnetic force generating coil may cause an insulation failure depending on temperature. Thus, it is conceivable to perform heat radiation by airflow as disclosed in the patent document to prevent a temperature rise in the section around the metal housing and an overheated state of the magnetic force generating coil.

SUMMARY OF THE INVENTION

It is an object of the present invention to at least partially solve the problems in the conventional technology.

A heat exhausting structure according to one aspect of the present invention includes a housing in which a heat source for heating a member to be heated is disposable, the housing includes a first end and a second end in a longitudinal direction, each of the first end and the second end being linked to a duct; and a blowing unit that is provided at the first end of the housing and causes an airflow in a space formed in a state in which the heat source is disposed in the housing. The duct linked to the second end of the housing is formed to extend from the second end. A length of the duct linked to the second end of the housing is longer than a hydraulic diameter by a predetermined number of times or more.

An image forming apparatus according to another aspect of the present invention includes a fixing unit that heats a recording medium onto which an image obtained by visualizing an electrostatic latent image that is formed by writing an image on a latent image carrier is transferred, to fix the image on the recording medium. The fixing unit includes a housing in which a heat source for heating a member to be heated is disposable, the housing includes a first end and a second end in a longitudinal direction, each of the first end and the second end being linked to a duct; and a blowing unit that is provided at the first end of the housing and causes an airflow in a space formed in a state in which the heat source is disposed in the housing. The duct linked to the second end of the housing is formed to extend from the second end. A length of the duct linked to the second end of the housing is longer than a hydraulic diameter by a predetermined number of times or more.

An image forming apparatus according to still another aspect of the present invention includes a latent image carrier on which an electrostatic latent image is formed; a writing unit that writes an image on the latent image carrier to form the electrostatic latent image; an image forming unit that visualizes the electrostatic latent image formed on the latent image carrier; a first forced intake unit that introduces air into the writing unit; a forced exhaust unit that is provided near a fixing unit that heats a recording medium with a heat source to fix an image on the recording medium, the forced exhaust unit exhausting the air to outside; and a second forced intake unit that is provided between the first forced intake unit and the forced exhaust unit, and introduces the air moving inside the image forming apparatus into the heat source of the fixing unit. The writing unit, the image forming unit, and the fixing unit are arranged from an upstream side to a downstream side in a moving direction of the air taken into the writing unit by the first forced intake unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a table for explaining a result of an experiment about a relation between an air volume based on an airflow velocity and a temperature change;

DETAILED DESCRIPTION OF THE PREFERRED EMBODIMENTS

Exemplary embodiments of the present invention are explained in detail below with reference to the accompanying drawings.

Figure 1:
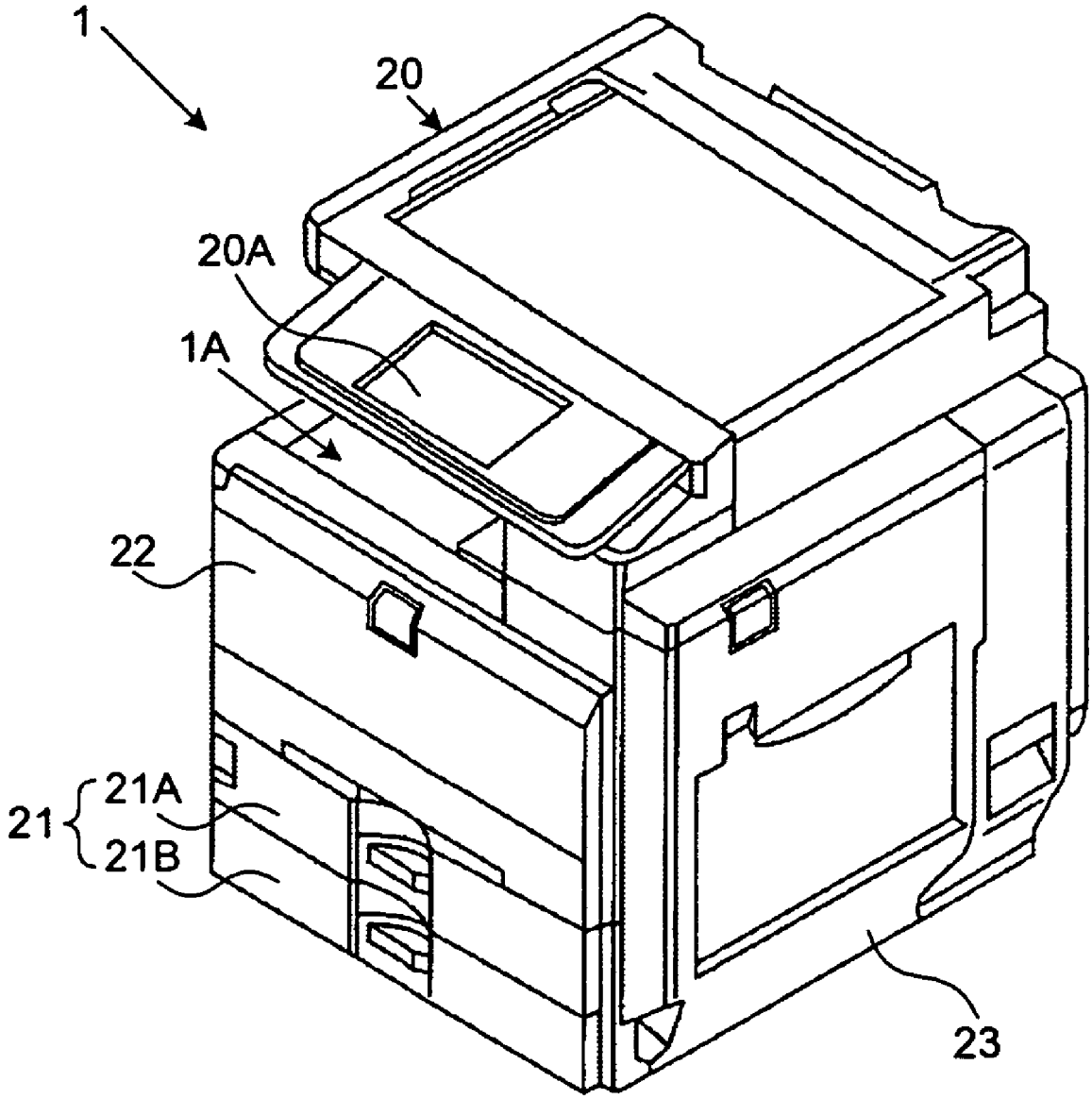
FIG. 1 is an external view of an example of an image forming apparatus including a fixing unit that adopts a heat exhausting structure according to a first embodiment of the present invention.

FIG. 1 is an external view of an image forming apparatus 1 in which a heat exhausting structure according to a first embodiment of the present invention is used. The image forming apparatus 1 shown in FIG. 1 is a color printer including a constitution of an image formation processing unit (hereinafter, "a color printer 1") shown in FIG. 2. However, the present invention includes not only the color printer but also a facsimile apparatus, a printing machine, and the like.

Figure 2:
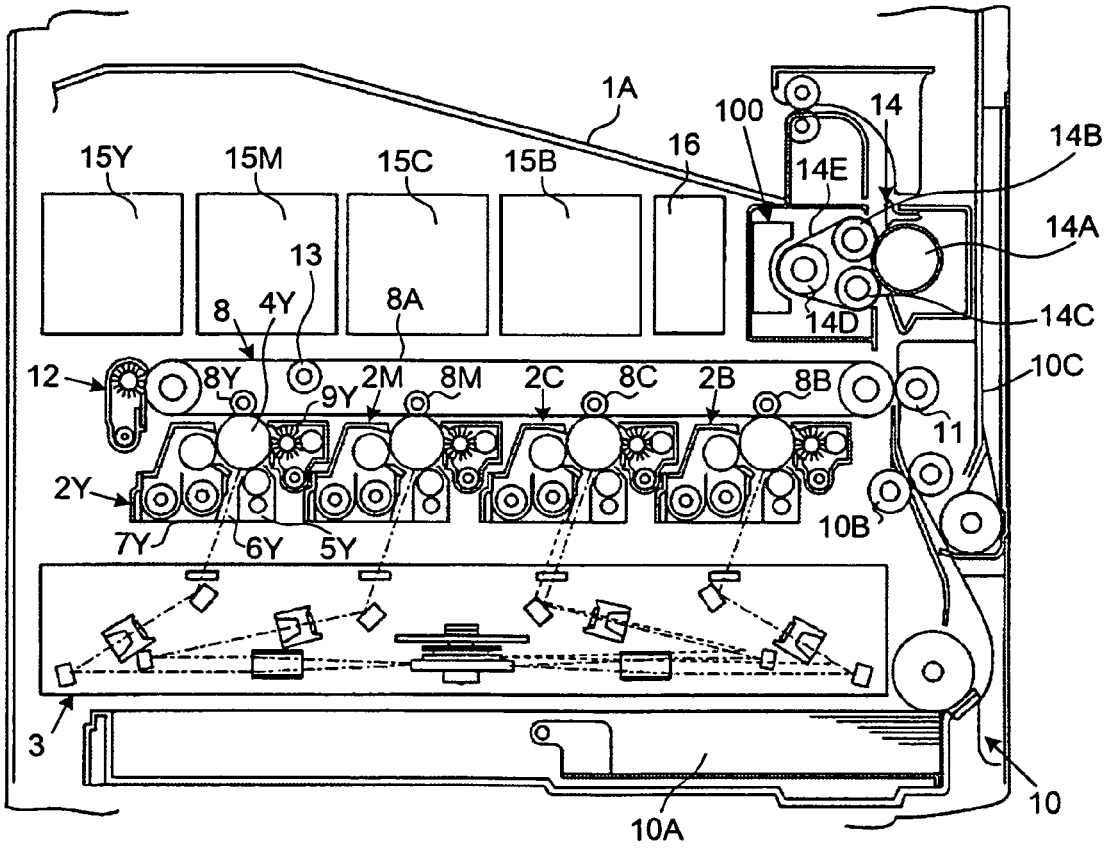
FIG. 2 is a schematic diagram for explaining a constitution of an image formation processing unit in the image forming apparatus shown in FIG. 1.

In a vertical direction of the color printer 1, an document scanning device 20 is arranged above a housing of the color printer 1 and a sheet feeding device 21 including a plurality of sheet feeding cassettes 21A and 21B is arranged below the hosing. Image forming units shown in FIG. 2 are provided between the document scanning device 20 and the sheet feeding device 21. A sheet discharge tray 1A forming a sheet discharge unit in a body of the color printer 1 is provided on an upper surface of the housing below the document scanning device 20 to make it unnecessary to provide a sheet discharge space for discharging a sheet to the outside of the color printer 1. An operation panel 20A is provided on a front surface of the document scanning device 20.

On the sides of the apparatus housing, covers 22 and 23 that opens-and closes are provided above the sheet feeding cassette 21A and on a wall surface in a direction perpendicular to a position above the sheet feeding cassette 21A, respectively. It is possible to open the covers 22 and 23, for example, when units forming an image formation processing unit described later are replaced or maintained.

FIG. 2 is a diagram showing the constitution of the image formation processing unit. In FIG. 2, the document scanning device 20 located above the image formation processing unit and the sheet feeding device 21 located below the image formation processing unit are not shown.

In FIG. 2, image forming units 2 capable of forming images of respective separated colors (for convenience of explanation, the image forming units are indicated by the reference numeral 2 affixed with capital letters Y, M, C, and B meaning yellow, magenta, cyan, and black) are arranged in parallel to one another. An exposure unit 3 is arranged below these image forming units 2Y, 2M, 2C, and 2B.

All the image forming units 2Y, 2M, 2C, and 2B have the same constitution. The constitution is explained below with the image forming unit 2Y that forms a yellow image as an example.

The image forming unit 2Y includes a rotatable photosensitive drum 4Y serving as a latent image carrier. A charging device 5Y for executing an image forming process, an incidence section 6Y on which writing light from the exposure unit 3 is made incident, a developing device 7Y, a transfer device 8, and a cleaning device 9Y are arranged around the photosensitive drum 4Y along a rotation direction, which is a clockwise direction in FIG. 2.

In FIG. 2, a trickle development system is adopted. In the trickle development system, a two-component developer including a toner and a carrier is used. It is possible to discharge an old developer to replace the old developer with a new developer by supplying the carrier in addition to the toner supply for correcting a concentration of the developer.

In FIG. 2, the transfer device 8 includes a transfer belt 8A that can move while being opposed to and coming into contact with photosensitive drums of the respective image forming units 2Y, 2M, 2C, and 2B. A transfer roller 8Y capable of applying a transfer bias is provided in a position opposed to the photosensitive drum 4Y across the transfer belt 8A.

The transfer device 8 according to the first embodiment carries out a primary transfer process for sequentially superimposing and transferring visual images born on photosensitive drums in the respective image forming units 2Y, 2M, 2C and 2B onto the transfer belt 8A and a secondary transfer process for collectively transferring the images superimposed on the transfer belt 8A onto a recording sheet or the like let out from the sheet feeding device 10. Therefore, a secondary transfer device 11 including a transfer roller capable of applying a transfer bias is arranged in a position where it is possible to carry out the secondary transfer process.

The sheet feeding device 10 includes a sheet feeding cassette 10A that houses recording sheets and a registration roller 10B arranged in a feeding path. The registration roller 10B is provided in a position where a conveying path for a recording sheet led in from a hand-supply sheet feeding tray 10C merges with a conveying path from the sheet feeding cassette 10A.

In FIG. 2, reference numeral 12 denotes a cleaning device for the transfer belt 8A and reference numeral 13 denotes a charge eliminating device for the transfer belt 8A.

In the image formation processing unit shown in FIG. 2, color images formed by the respective image forming units 2Y, 2M, 2C, and 2B are sequentially superimposed and transferred onto the transfer belt 8A of the transfer device 8 in the primary transfer process. The color images superimposed and transferred onto the transfer belt 8A are collectively transferred onto a recording sheet in the secondary transfer process. Then, the color images are fixed on the recording sheet by a fixing unit 14.

The recording sheet with the color images fixed thereon is discharged onto the sheet discharge tray 1A that is provided in the color printer 1 and forms the sheet discharge unit in the body of the color printer 1 as shown in FIG. 1.

Toner supply units 15Y, 15M, 15C, and 15B used for the trickle development system and a carrier supply unit 16 used with the respective toner supply units are arranged in a space above the respective image forming units 2Y, 2M, 2C, and 2B.

In FIG. 2, the fixing unit 14 includes a fixing belt 14E wound around rollers 14B and 14C and a heating roller 14D. The rollers 14B and 14C are arranged along a circumferential direction of a pressure roller 14A. The heating roller 14D is provided in a position opposed to the pressure roller 14A across the rollers 14B and 14C. The fixing belt 14E is heated by an electromagnetic induction heating unit 100 serving as an external heating source arranged near the surface of the fixing belt 14E.

Figure 3A:
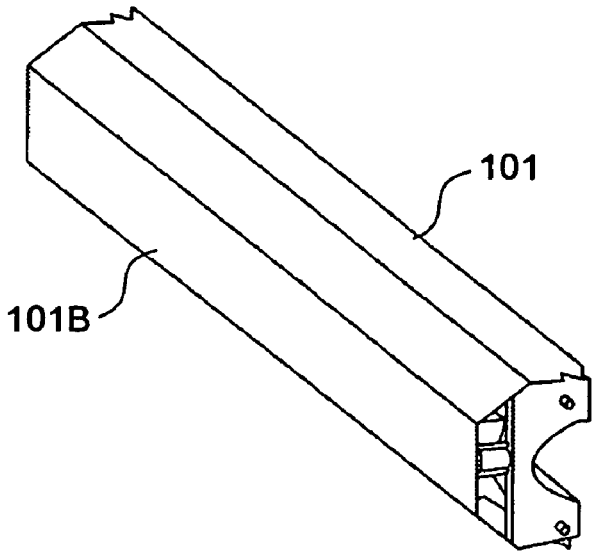
FIG. 3A is an external view of an electromagnetic induction heating unit used in the fixing unit in the image forming apparatus shown in FIG. 1.
Figure 3B:
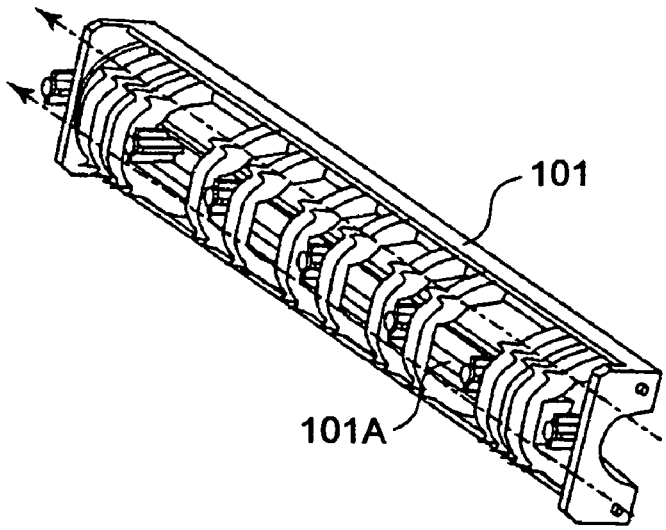
FIG. 3B is a diagram for explaining a state in which an armor panel of the electromagnetic induction heating unit in FIG. 3A is removed to expose the inside thereof.

FIGS. 3A and 3B are diagrams of a constitution of the electromagnetic induction heating unit 100. FIG. 3A is a diagram of an external appearance of the electromagnetic induction heating unit 100. FIG. 3B is a diagram for explaining a state in which an armor panel of the electromagnetic induction heating unit 100 in FIG. 3A is removed to expose the inside thereof.

In FIGS. 3A and 3B, the electromagnetic induction heating unit 100 includes a heat source housing 101 that has a space for arranging a magnetic force generating coil 101A in the inside thereof. A part of an outer hull of the heat source housing 101 is formed in a shape that can surround a part of the heating roller 14 (see FIG. 2). The magnetic force generating coil 101A is extended in a direction parallel to a width direction of the recording sheet that passes through the fixing unit 14. The magnetic force generating coil 101A is supported by the heat source housing 101 in a plurality of places along a longitudinal direction (an extending direction) thereof.

In an internal space of the heat source housing 101, a space between the heat source housing 101 and an armor panel 101B (see FIG. 3A) excluding the supporting positions of the magnetic force generating coil 101A is formed as an airflow passing space that pierces through the heat source housing 101 in the longitudinal direction (the extending direction). As indicated by arrows of alternate long and short dash lines in FIG. 3B, it is possible to lead in the external air from one end in the longitudinal direction (the extending direction) and discharge the external air from the other end in the longitudinal direction (the extending direction).

Figure 4:
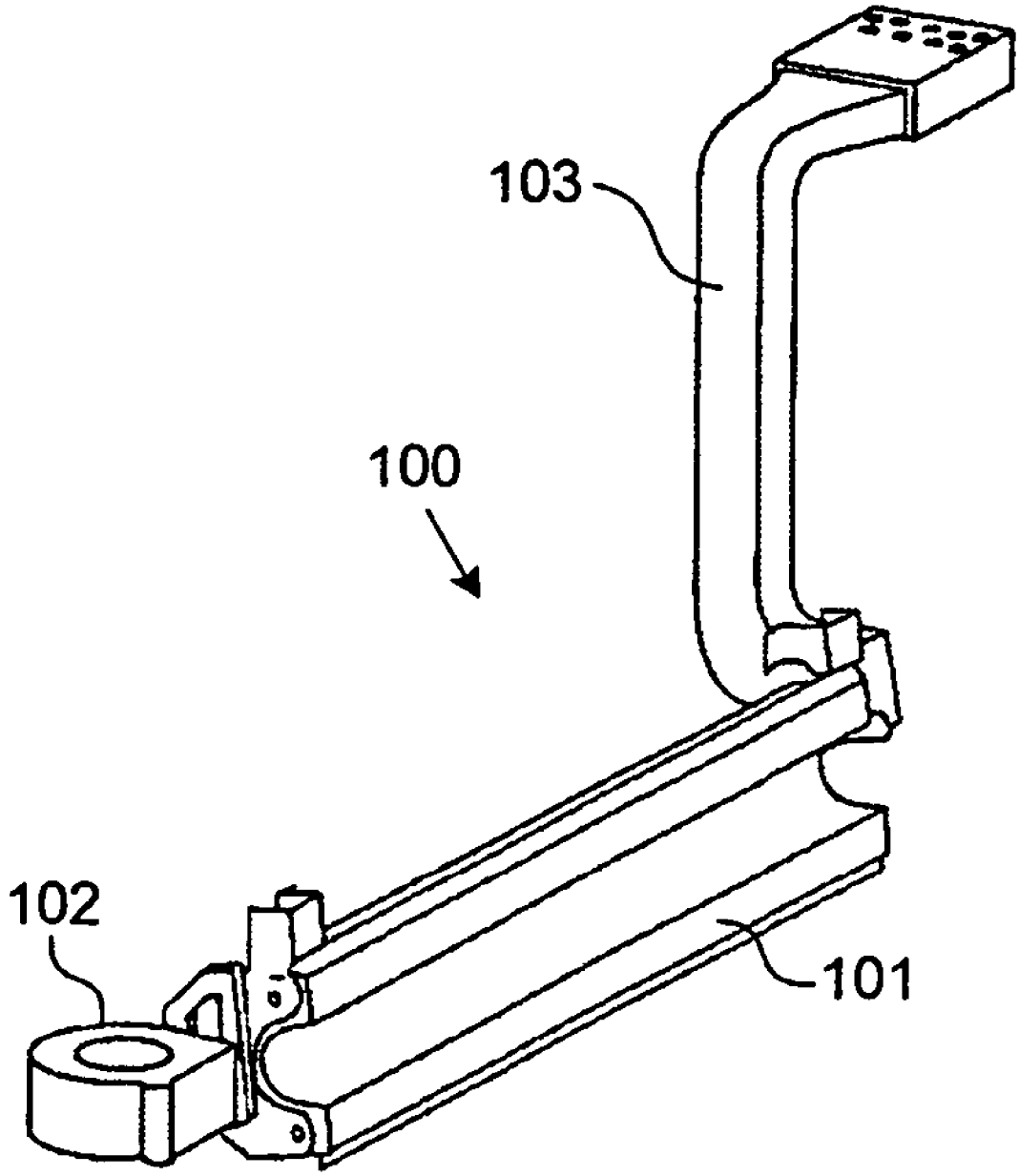
FIG. 4 is an external view of a constitution of a heat source housing of the electromagnetic induction heating unit in the heat exhausting structure according to the first embodiment.

One end in the longitudinal direction (the extending direction) of the heat source housing 101 is an intake side for taking in the external air. As shown in FIG. 4, a duct of a sirocco fan 102, which can lead in the external air to positively pressurize the space, is linked to this end. A chimney-like exhaust duct 103 is linked to the other end in the longitudinal direction (the extending direction).

Unlike an axial flow fan, the sirocco fan 102 is advantageous in that, even if the sirocco fan 102 is small, it is possible to relatively secure a desired flow rate. According to the first embodiment, depending on a size of a recording sheet on which an image is fixed, a flow rate (Q) of the sirocco fan 102 is set to be larger than 0.03 $m^3$/min and smaller than 0.15 $m^3$/min.

FIGS. 5A to 5D are diagrams for explaining a reason for setting the flow rate.

Figure 5A:
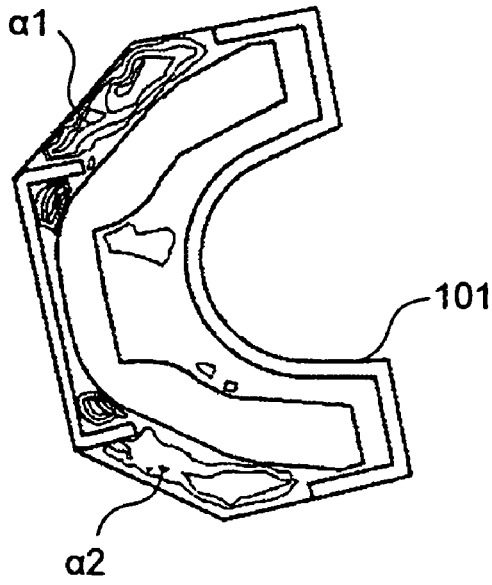
FIG. 5A is a diagram for explaining a flow velocity distribution in an airflow discharge section on the other end side in a longitudinal direction (an extending direction) of the heat source housing in the electromagnetic induction heating unit shown in FIG. 4.
Figure 5B:
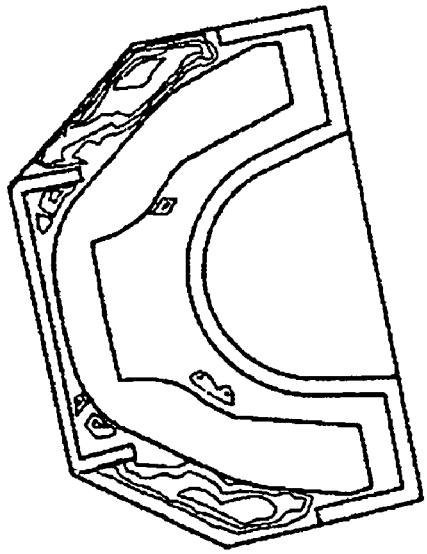
FIG. 5B is a diagram for explaining a flow velocity distribution in an external air lead-in section on one end side in the longitudinal direction (the extending direction)
Figure 5C:
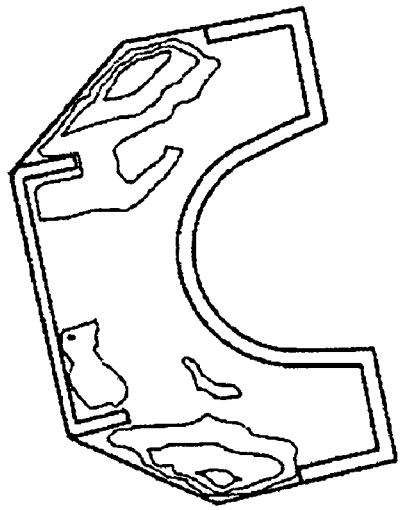
FIG. 5C is a diagram for explaining a flow velocity distribution in the center in the longitudinal direction (the extending direction) that is a section between the ends.
Figure 5D:
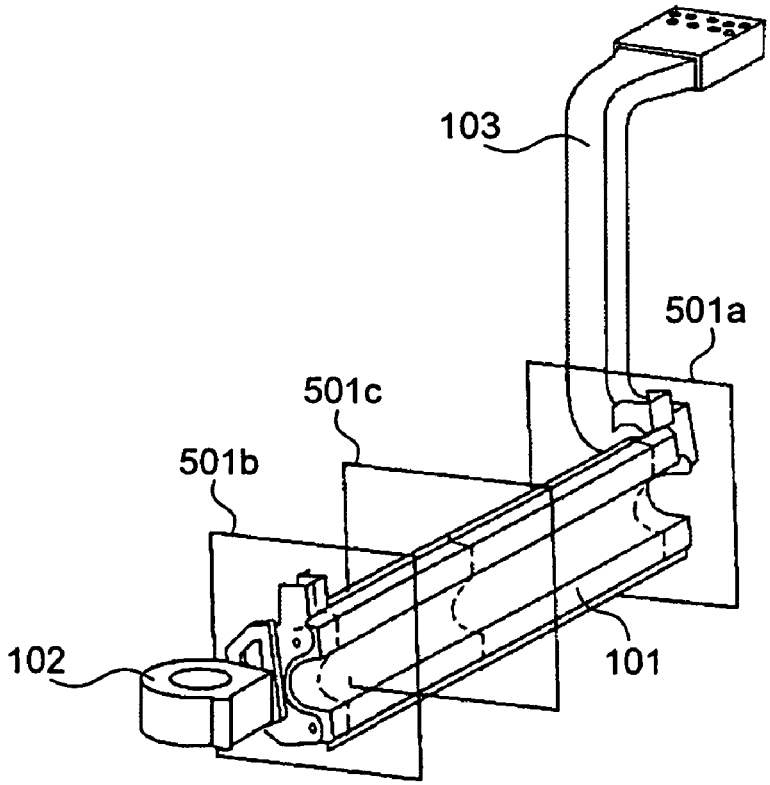
FIG. 5D is a perspective view of the heat source housing shown in FIG. 4.

FIG. 5A is a diagram for explaining a flow velocity distribution in an airflow discharge section 501*a* on the other end side in the longitudinal direction (the extending direction) of the heat source housing 101 in the electromagnetic induction heating unit 100 shown in FIG. 5D. FIG. 5B is a diagram for explaining a flow velocity distribution in an external air lead-in section 501*b* on one end side in the longitudinal direction (the extending direction). FIG. 5C is a diagram for explaining a flow velocity distribution in the center 501*c* in the longitudinal direction (the extending direction) that is a section between these ends.

In FIGS. 5A to 5C, levels of a flow velocity are represented in a shape of contour lines. As a contour is smaller, a flow velocity is higher. Specifically, a flow velocity is about 3.5 m/s in a part where a contour is the smallest. An outer side of a part where a contour is the largest has a velocity of 0 m/s.

FIG. 5A is a result obtained by measuring a velocity in a position 1 centimeter to the inner side from the other end in the longitudinal direction (the expending direction) that is the airflow discharge section. FIG. 5B is a result obtained by measuring a velocity in a position 1 centimeter to the inner side from one end in the longitudinal direction (the extending direction) that is the external air lead-in section.

In FIGS. 5A to 5C, in piercing-through sections (denoted by reference signs $\alpha$1 and $\alpha$2) serving as airflow passing spaces in an area leading from one end to the other end along the longitudinal direction (the extending direction), a maximum velocity of 3.6 m/s was obtained and a general velocity of 1 m/s to 3 m/s was obtained by setting the flow rate described above.

Temperatures on the surface of the armor panel in the respective sections at the time when airflow passes through the piercing-through sections at this velocity, that is, cooling states on the surface due to heat radiation are substantially uniform. Cooling is made uniform over the entire area in the longitudinal direction (the extending direction) of the heat source housing 101 to prevent an extreme overheated state from occurring in a section around the heat source housing 101.

Figure 7:
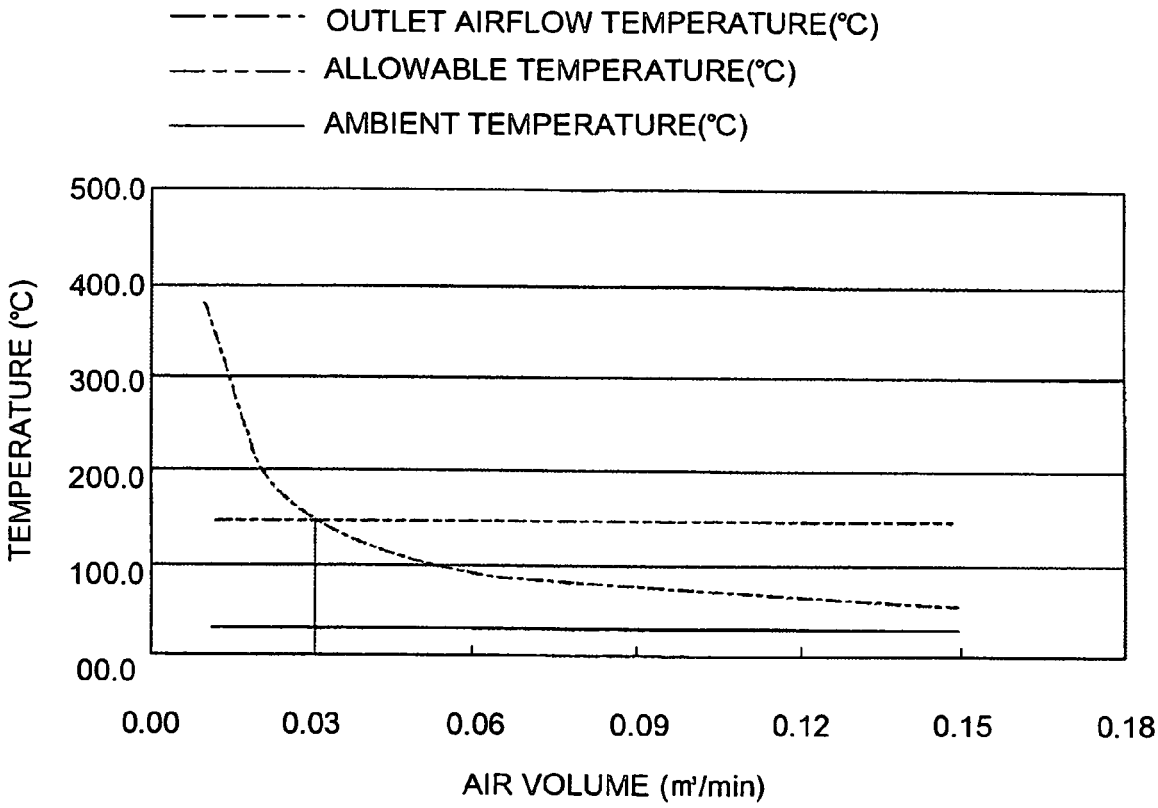
FIG. 7 is a graph representing the result of the experiment shown in FIG. 6 as a state of change.

When the inventor performed experiments on an air volume based on an airflow velocity and temperature changes in the respective sections in the heat source housing 101, a result shown in FIGS. 6 and 7 was obtained.

FIG. 6 is a table of a relation among an airflow temperature on the other end side in the longitudinal direction (the extending direction) equivalent to the airflow discharge section in the heat source housing 101, an air volume, an allowable temperature set in the heat source housing 10, and an ambient temperature in the section around the fixing unit. FIG. 7 is a graph representing a state of change from a map in FIG. 6. As it is clear from this result, it is possible to prevent an overheated state in the electromagnetic induction heating unit 100 and control a thermal adverse effect such as a temperature rise in the section around the fixing unit by simply setting an air velocity.

On the other hand, length leading from the other end to one end in the longitudinal direction (the extending direction) of the exhaust duct 103 provided at the other end in the longitudinal direction (the extending direction) of the heat source housing 101 is set to ten times or more as large as a hydraulic diameter thereof (4×average area of the duct/average sectional peripheral length of the duct).

According to the setting of length of the exhaust duct 103, airflow that has passed through the heat source housing 101 is not directly discharged to the outside. Thus, a discharge sound caused when the airflow is directly discharged to the outside and an airflow sound caused when the airflow passes through the heat source housing 101 do not leak out. Roughly speaking, this is considered to be because attenuation of a velocity of the airflow is caused by a viscous resistance and an abrasion resistance between the airflow and the inner surface of the exhaust duct 103 when the airflow passes through the exhaust duct 103 and impetus of discharge of the airflow from the exhaust duct 103 is weakened by the attenuation of a velocity.

Figure 8:
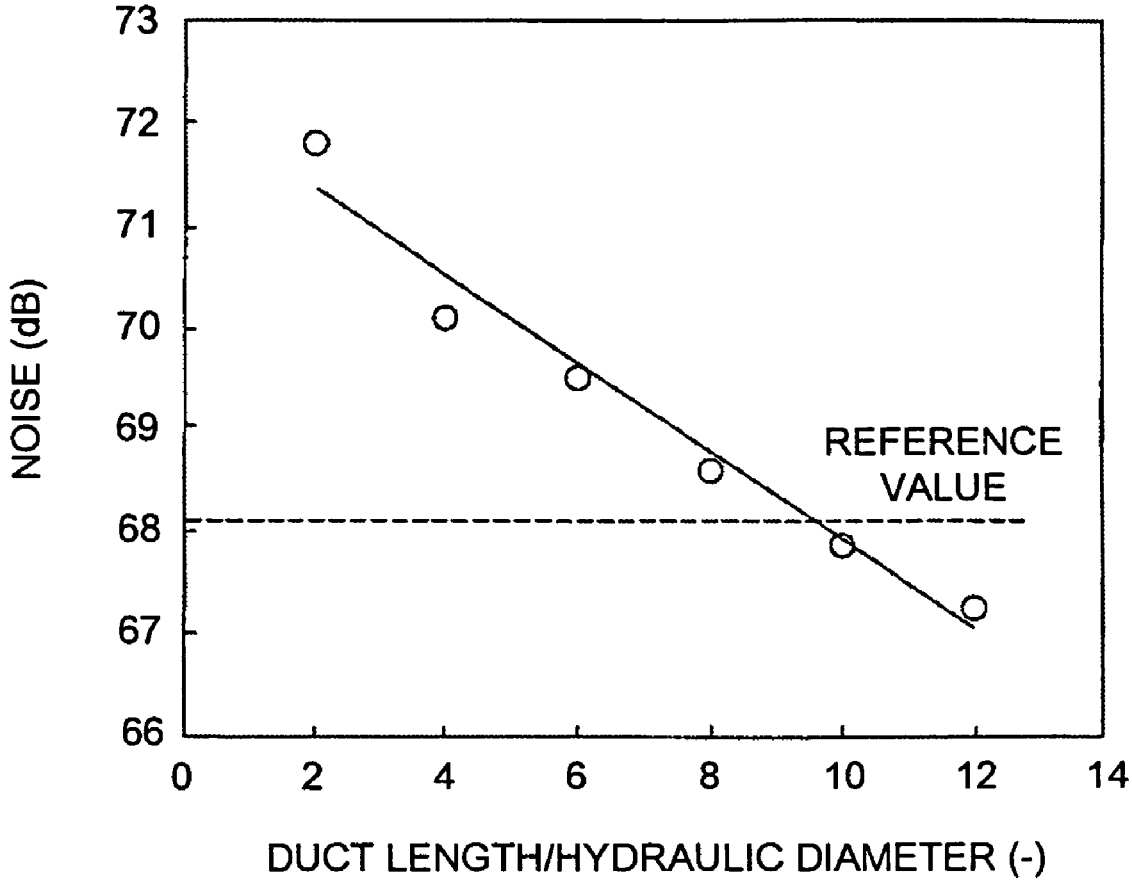
FIG. 8 is a graph for explaining a relation between length of an exhaust duct and a noise.

The inventor performed experiments to find how a noise in an exhaust duct outlet changed when length of the exhaust duct 103 was changed. As shown in FIG. 8, from the experiments, the inventors successfully confirmed that it was possible to maintain a noise equal to or lower than a noise reference value if the length of the exhaust duct 103 was ten times or more as large as a hydraulic diameter thereof. In this case, although the length of the exhaust duct 103 is set to ten times or more as large as the hydraulic diameter, this does not means that the length of the exhaust duct 103 may be set large at random. Naturally, there is an upper limit of the length of the exhaust duct 103 depending on conditions such as a capacity and a setting space of a sirocco fan and a range of selection of a lower limit value of the length at the time when noise is equal to or lower than the noise reference value.

Figure 9A:
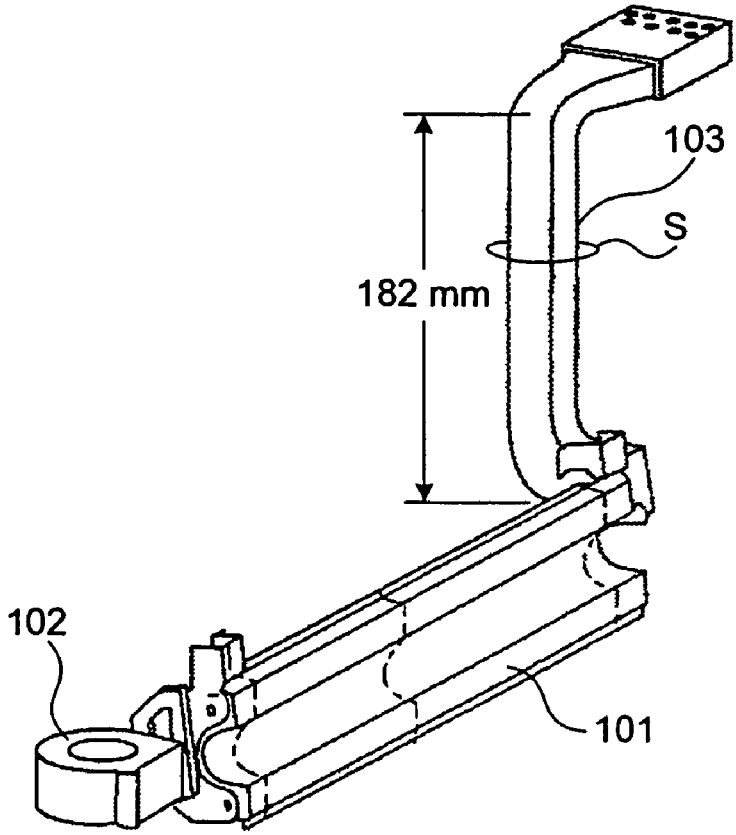
FIG. 9A is a diagram for explaining the length of the exhaust duct as a condition for obtaining the relation shown in FIG. 8.
Figure 9B:
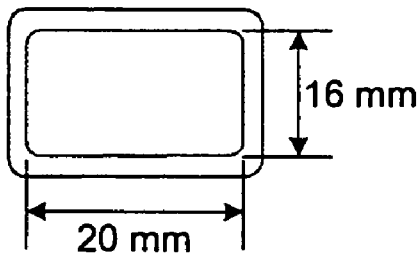
FIG. 9B is a diagram of a sectional dimension of the exhaust duct.

In FIGS. 9A and 9B, length of the exhaust duct 103 is set to 182 millimeters and a hydraulic diameter in a cross section of the exhaust duct 103 indicated by reference sign S in FIG. 9A is set to 4×(16 mm×20 mm)/72=17 mm. A result shown in FIG. 8 is a result in this case. The length of the exhaust duct 103 is ten times or more as large as the hydraulic diameter. Thus, it is possible to keep a noise equal to or lower than the reference value.

A not-shown replaceable filter is provided in the external air lead-in section at one end in the longitudinal direction (the extending direction) in the electromagnetic induction heating unit 100. The filter prevents foreign matters, for example, toner powder flying around the electromagnetic induction heating unit 100 from entering the position where the magnetic force generating coil is arranged. This makes it possible to prevent adhesion of the foreign matters to the coil and pollution of the inside of the electromagnetic induction heating unit 100.

Figure 10:
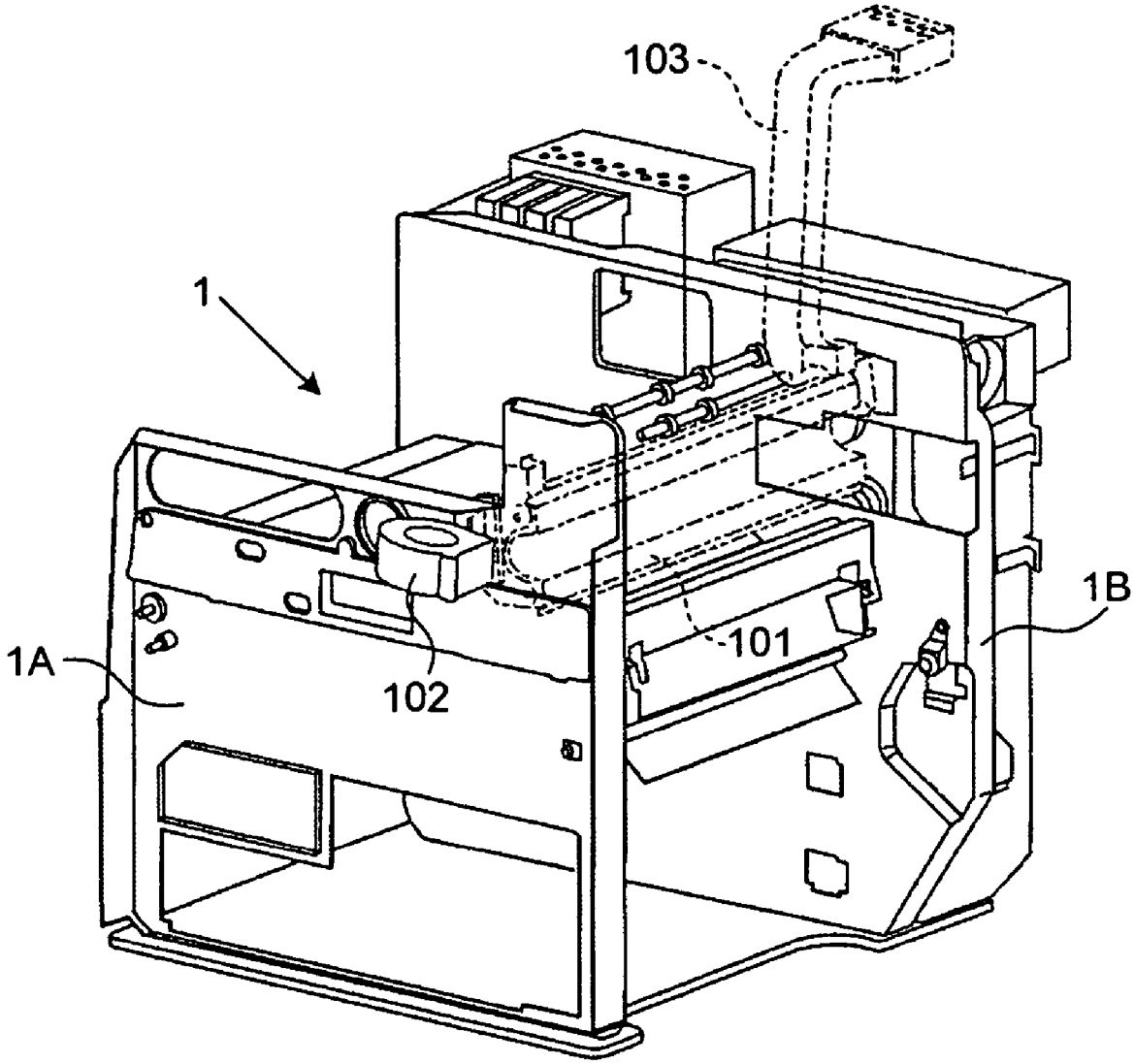
FIG. 10 is a diagram for explaining a state in which the electromagnetic induction heating unit shown in FIG. 4 is built in an image forming apparatus.

The heat exhausting structure according to the first embodiment has the constitution described above. Thus, as shown in FIG. 10, both ends in the longitudinal direction (the extending direction) of the electromagnetic induction heating unit 100 provided in the fixing unit 14 are supported by the support walls 1A and 1B of the color printer 1. The sirocco fan 102 that has the duct linked to one end in the longitudinal direction (the extending direction) of the heat source housing 101 is attached to the outer side of the support wall 1A.

In the electromagnetic induction heating unit 100, foreign matters included in the external air led in by the sirocco fan 102 are collected by the filter. Thus, the internal space of the electromagnetic induction heating unit 100 and the magnetic force generating coil are maintained in a clean state. Consequently, short circuit and pollution due to adhesion of foreign matters to the magnetic force generating coil are prevented. This makes it possible to maintain a heat generation state for reducing time for warming-up.

On the other hand, the external air led into the heat source housing 101 is brought into a positively pressurized state by the sirocco fan 102. Thus, even if there are members highly densely arranged in the heat source housing 101, airflow can pass through the heat source housing 101 because the airflow is forcibly pressed into the heat source housing 101 without being hindered. In particular, a flow velocity is maintained at a predetermined velocity. Consequently, it is possible to expect a uniform cooling effect in the longitudinal direction (the extending direction) of the heat source housing 101 because deterioration in heat radiation efficiency due to the stagnant airflow is not caused.

Moreover, the airflow that has moved into the exhaust duct 103 passing through the heat source housing 101 causes attenuation of a velocity of the airflow because of the length of the exhaust duct 103. Consequently, unlike a pressure at the time when the airflow is directly discharged to the outside from the heat source housing 101, a pressure at the time of discharge is reduced and a sound pressure recognized as noise is not caused because an impetus of movement of the airflow is weakened. This makes it possible to surely prevent occurrence of environmental noise.

According to the first embodiment, the electromagnetic induction heating system is used as a system for an external heat source. However, the present invention is not limited to this. It is possible to apply the present invention to an external heat source of a lighting and heating system that uses a coil.

Figure 11:
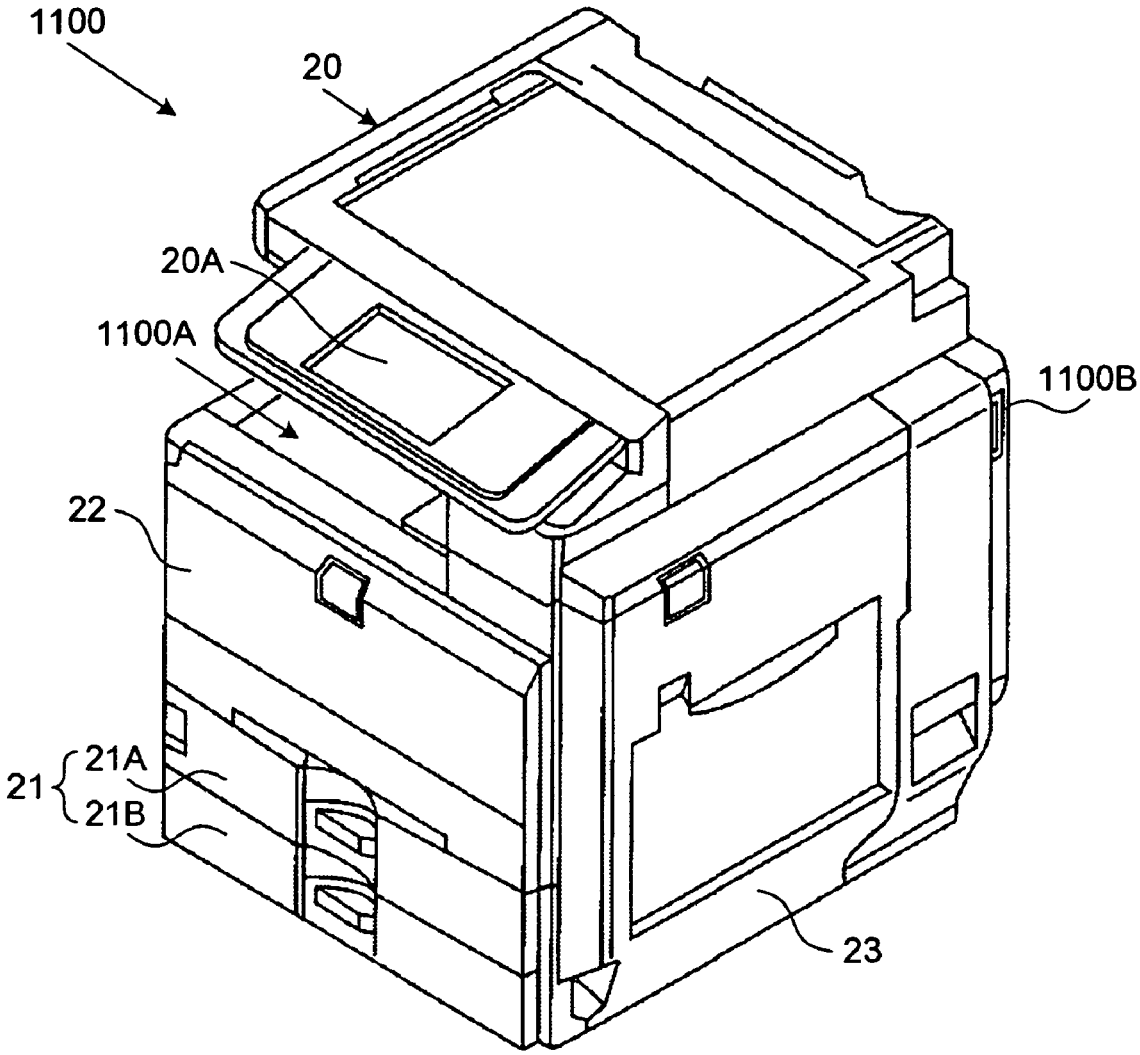
FIG. 11 is an external view of an example of an image forming apparatus including a fixing unit that adopts a heat exhausting structure according to a second embodiment of the present invention.

FIG. 11 is an external view of an image forming apparatus 1100 according to a second embodiment of the present invention in which the heat exhausting structure according to the first embodiment is used. The image forming apparatus 1100 shown in FIG. 11 is a color printer (hereinafter, "a color printer 1100") including an image formation processing unit shown in FIG. 12. However, the present invention includes not only the color printer but also a facsimile apparatus and a printing machine.

In FIG. 11, the color printer 1100 is different from the color printer 1 according to the first embodiment shown in FIG. 1 in that an exhaust duct 1000B is provided. The other components of the color printer 1100 shown in FIG. 11 are the same as those of the color printer 1 shown in FIG. 1.

Figure 12:
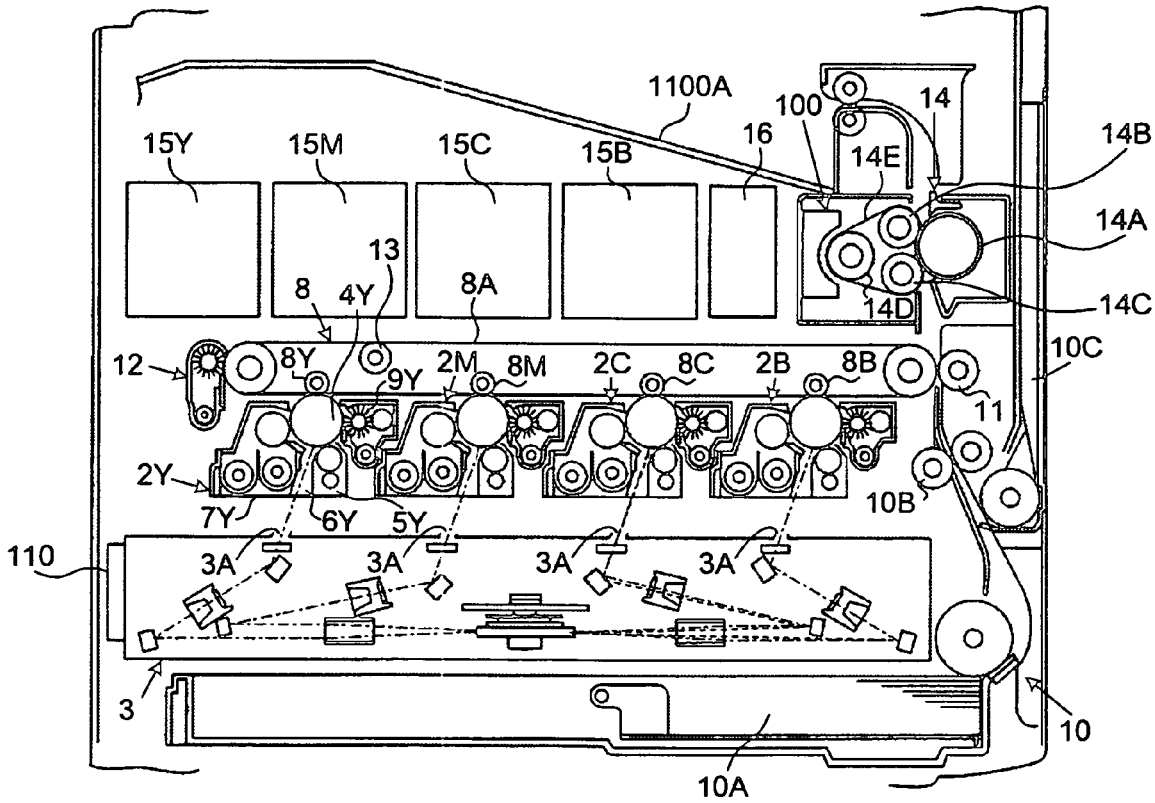
FIG. 12 is a diagram for explaining a constitution of an image formation processing unit in the image forming apparatus shown in FIG. 11.

In FIG. 12, the color printer 1100 is different from the color printer 1 according to the first embodiment shown in FIG. 2 in that axial flow fans 110 are provided in the exposure unit 3. The other components of the color printer 1100 shown in FIG. 12 are the same as those of the color printer 1 shown in FIG. 2.

In the color printer 1100 according to the second embodiment, an electromagnetic induction heating unit has the same constitution as the electromagnetic induction heating unit according to the first embodiment shown in FIGS. 3A and 3B. A heat source housing of the electromagnetic induction heating unit in a heat exhausting structure according to the second embodiment has the same constitution as the heat source housing of the electromagnetic induction heating unit according to the first embodiment shown in FIG. 4.

The color printer 1100 including such components has a constitution for forcibly discharging the overheated air, which tends to stay in the color printer 1100, to the outside.

Figure 13:
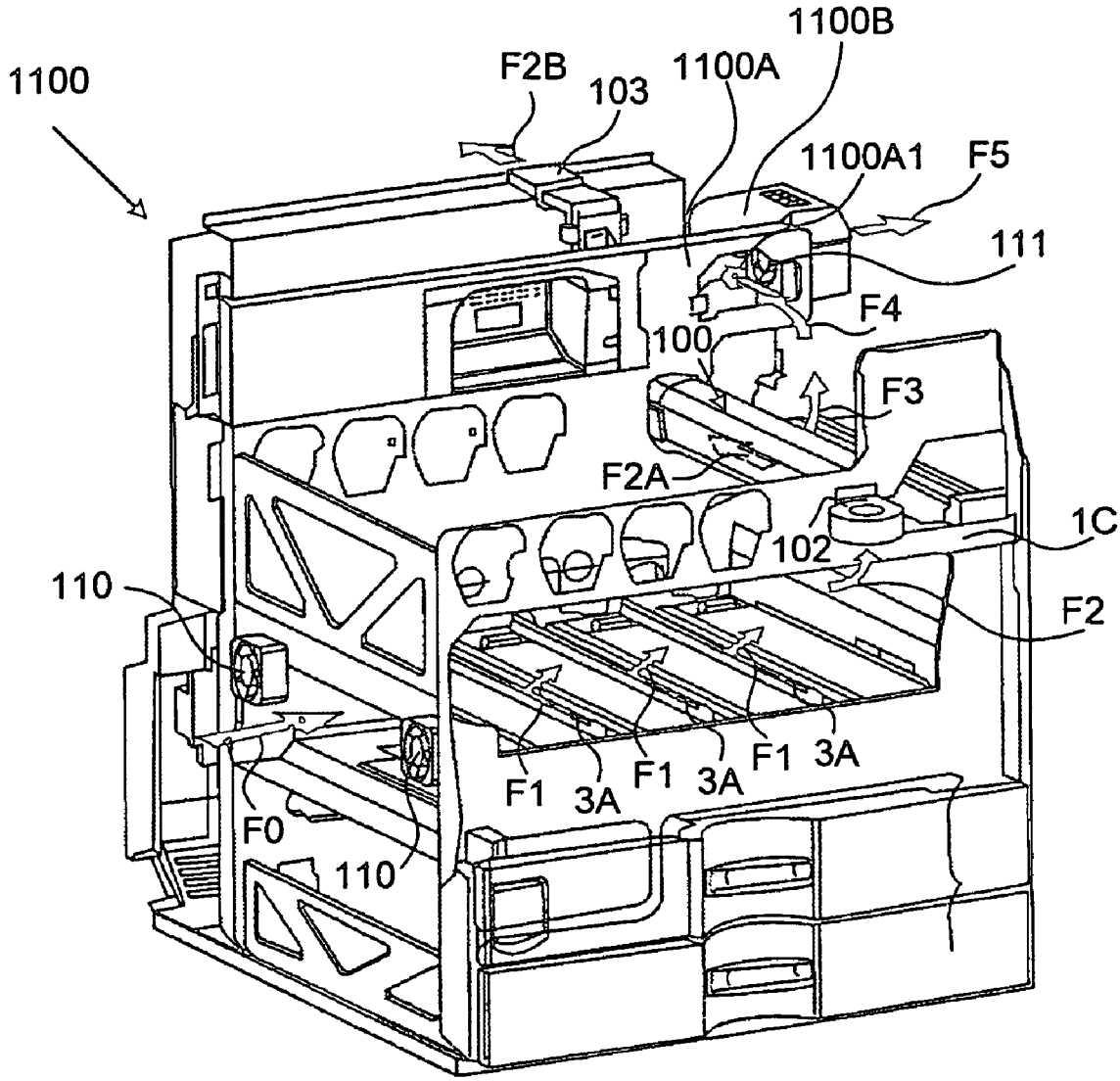
FIG. 13 is a perspective view for explaining the heat exhausting structure used in the image forming apparatus according to the second embodiment.

In FIG. 13, members used for forced discharge of the overheated air include the axial flow fans 110 (first forced intake units) provided in the exposure unit 3, an axial flow fan 111 (a forced exhaust unit) provided in a housing section of the color printer 1100 near the fixing unit 14, and the sirocco fan 102 (a second forced intake unit) provided in the electromagnetic induction heating unit 100 included in the fixing unit 14. In FIG. 13, for convenience of illustration, the image forming units 2Y, 2M, 2C, and 2B shown in FIG. 12 are not shown.

According to the second embodiment, airflow is not only forcibly caused using the fans but also effectively moved in the housing. The external air led in by the axial flow fans 110 does not move according to a pressure difference in the housing and a velocity given to the external air. Instead, a moving process of the external air is taken into account to prevent a toner from entering the exposure unit 3 and prevent heat of the fixing unit 14 from adversely affecting the other units.

Emission openings 3A for emitting writing light to the photosensitive drums are formed on an upper surface of a unit case opposed to bottom surfaces of the image forming units 2Y, 2M, 2C, and 2B. The emission openings 3A are used as discharge sections for discharging the external air led into the housing of the color printer 1100.

As shown in FIGS. 12 and 13, the axial flow fans 110 provided in the exposure unit 3 are arranged on both sides in a direction perpendicular to a parallel arrangement direction of the image forming units 2Y, 2M, 2C, and 2B, that is, a moving direction of the air from the axial flow fans 110 in a wall at an end on one side in the longitudinal direction of the exposure unit 3, that is, the parallel arrangement direction of the image forming units 2Y, 2M, 2C, and 2B and on a side far from the fixing unit 14.

Figure 14A:
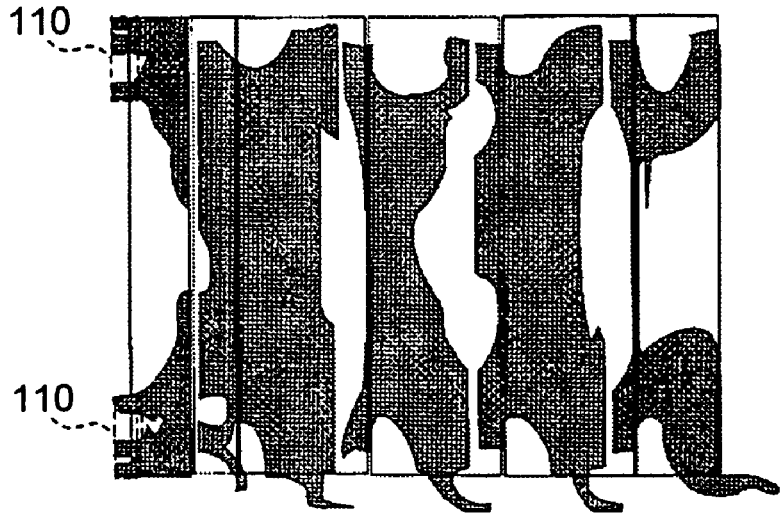
FIG. 14A is a diagram for explaining a flow of the air by first forced intake units of the heat exhausting structure shown in FIG. 13.
Figure 14B:
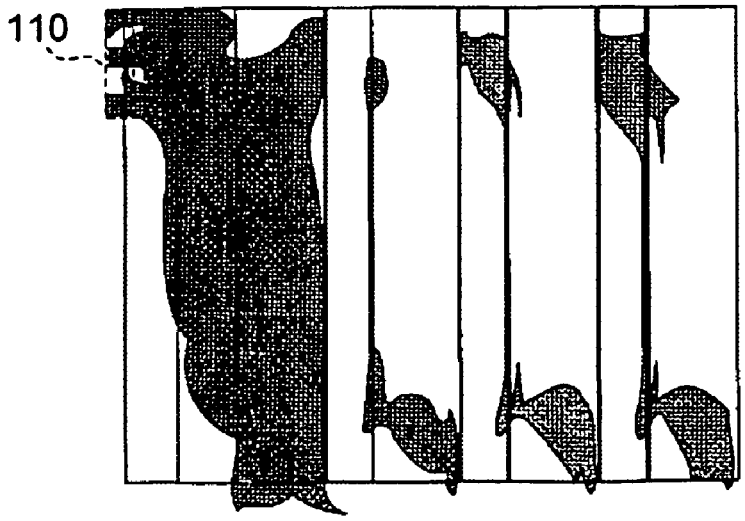
FIG. 14B is a diagram for explaining a flow of the air by a single forced intake unit.

FIGS. 14A and 14B are diagrams for explaining a reason why the axial flow fans 110 are provided on both the sides. In FIG. 14A, the axial flow fans 110 are arranged on both the sides as according to the second embodiment. In FIG. 14B, the axial flow fan 110 is arranged only on one side.

In FIGS. 14A and 14B, sections colored in black indicate sections where a flow velocity is equal to or higher than 0.5 m/s. As it is evident from FIGS. 14A and 14B, when the axial flow fans 110 are arranged on both the sides as according to the second embodiment, it is possible to move the external air substantially in a uniform velocity distribution state from an upstream side to a downstream side in the moving direction of the external air. On the other hand, when the axial flow fan 110 is arranged only on one side as shown in FIG. 14B, a uniform velocity distribution state is deflected only to a section near the discharge section of the axial flow fan 110, that is, the upstream side in the moving direction of the external air. Thus, it is difficult to obtain the uniform velocity state from the upstream side to the downstream side in the moving direction.

In FIG. 13, the axial flow fan. 111 is provided in the inside of the exhaust duct 1100B linked to an air intake opening 1010A1 formed above the support position for the electromagnetic induction heating unit 100 in a housing wall plate 1100A that supports the electromagnetic induction heating unit 100 included in the fixing unit 14. Consequently, the air in the apparatus led into the exhaust duct 1100B from the air intake opening 1010A1 is discharged to the outside of the housing. In FIG. 11, for convenience of illustration, reference sign 1100B denotes a position of the exhaust duct.

According to the second embodiment, a total intake volume (Qin) of the axial flow fans 110 is set larger than a total exhaust volume (Qout) of the axial flow fan 111 (Qin>Qout).

Consequently, the housing is positively pressurized according to the intake of the external air from the axial flow fans 110. This makes it possible to prevent the external air from entering the housing from places other than the exposure unit 3. This makes it possible to rectify movement of the external air taken into the exposure unit 3 by the axial flow fans 110 and move the external air to the axial flow fan 111. Therefore, since a turbulent flow does not occur in the air moving through the housing, the air does not stay in a part of the housing. This makes it possible to prevent heat radiation efficiency from falling.

The total intake volume (Qin) of the axial flow fans 110 is set larger than a sum of an intake volume (Qmid) of the sirocco fan 102 and the total exhaust volume (Qout) of the axial flow fan 111 (Qin>Qout+Qmid).

Consequently, the air taken into the housing is positively pressurized. This makes it possible to prevent the external air from entering the housing from places other than the intake position, for example, a gap formed in a joining surface of a cover used for covering the inside of the housing and rectify a flow of the air moving through the housing.

Since the color printer 1100 according to the second embodiment has the constitution described above, only the exposure unit 3 is provided as the position for taking the external air into the housing. The exposure unit 3, the image forming units 2Y, 2M, 2C, and 2B, and the fixing unit 14 are arranged in this order from the upstream side to the downstream side in the moving direction of the air that moves through the housing.

In FIG. 13, an external air F0 taken in by the axial flow fans 110 provided in the exposure unit 3 is discharged from the emission openings 3A formed in the exposure unit 3 to traverse the inside of the housing along the parallel arrangement direction of the image forming units 2Y, 2M, 2C, and 2B. In other words, the air moving through the housing is discharged from the emission openings 3A of the exposure unit 3 (as indicated by reference sign F1) and moves to the bottom surfaces and the sides of the image forming units 2Y, 2M, 2C, and 2B. In this case, the housing is positively pressurized because a total intake volume of the axial flow fans 110 is larger than flow rates of the air moved by the other fans. Thus, a pressure sufficient for causing the air to traverse the inside of the housing along the parallel arrangement direction of the image forming units 2Y, 2M, 2C, and 2B and moving the air to the sides of the image forming units 2Y, 2M, 2C, and 2B is maintained.

The air that has moved to the sides of the image forming units 2Y, 2M, 2C, and 2B (as indicated by reference sign F2) can flow in a lateral direction from a housing sidewall 1C and, then, flow into the sirocco fan 102. The air taken into the sirocco fan 102 moves through the electromagnetic induction heating unit 100 (as indicated by reference sign F2A) and discharges the overheated air in the heating source to the outside from the exhaust duct 103 (as indicated by reference sign F2B).

On the other hand, the air that has moved along the parallel arrangement direction of the image forming units 2Y, 2M, 2C, and 2B come into collision with the wall surface and the like in the housing and moves in a rising direction according to generation of an upward airflow due to the ambient temperature of the fixing unit 14 (as indicated by reference sign F3). The air is taken into the air intake opening 1100A1 of the housing wall plate 1100A by the axial flow fan 111 in the duct 1B and discharged to the outside (as indicated by reference signs F4 and F5).

In the color printer 1100 according to the second embodiment having the constitution described above, the air comes closer to heat generating sources as the air moves from the upstream side to the downstream side in the moving direction of the air. Thus, propagation of the hot air from the fixing unit 14 serving as a heat generating source to the image forming units 2Y, 2M, 2C, and 2B and the exposure unit 3 is prevented by the movement of the air. In particular, the air that flows from the upstream side in the moving direction is forcible moved by the suction of the axial flow fan 111 while rising near the fixing unit 14 and is discharged to the outside. Thus, the air does not stay around the fixing unit 14. This makes it possible to prevent the ambient temperature around the fixing unit 14, which is caused by the overheated state of the stagnant air, from abnormally rising.

The air taken into the housing from the outside is discharged to the lower surfaces of the image forming units 2Y, 2M, 2C, and 2B via the emission openings 3A provided in the exposure unit 3 and directly moves to traverse the inside of the housing along the parallel arrangement direction of the image forming units 2Y, 2M, 2C, and 2B. Thus, a toner is prevented from entering the exposure unit 3 and pollution of the optical components in the exposure unit 3 is prevented. As a result, it is possible to prevent defects of a written image due to the pollution of the optical components and prevent formation of a defective image.

Only the exposure unit 3 is provided as an external air intake section. Thus, unlike the constitution in which openings are provided as external air intake sections in association with places that require cooling, it is possible to control generation of an intake sound and reduce environmental noise.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A heat exhausting structure, comprising:

a housing in which a heat source for heating a member to be heated is disposed, the housing includes a first end and a second end in a longitudinal direction, each of the first end and the second end being linked to a duct, wherein the member to be heated is external to the housing; and a blowing unit that is provided at the first end of the housing and causes an airflow in an internal space of the housing in which the heat source is disposed, wherein the duct linked to the second end of the housing is formed to extend from the second end, and a length of the duct linked to the second end of the housing is longer than a hydraulic diameter of the duct by a predetermined number of times or more.

2. The heat exhausting structure according to claim 1, wherein the length of the duct linked to the second end is set to ten times or more of 4×average area of the duct/average sectional peripheral length of the duct.

3. The heat exhausting structure according to claim 1, wherein the heat source includes an electromagnetic induction heating unit that has a magnetic force generating coil.

4. The heat exhausting structure according to claim 1, wherein the blowing unit includes a sirocco fan with a flow rate set to be between 0.03 $m^3$/min-0.15 $m^3$/min.

5. The heat exhausting structure according to claim 4, wherein the blowing unit positively pressurizes the space.

6. The heat exhausting structure according to claim 1, further comprising:

a replaceable filter provided on a side of the second end where air is introduced from outside.

7. The heat exhausting structure according to claim 1, wherein the duct linked to the second end of the housing is formed to extend upwards from the second end.

8. An image forming apparatus comprising:

a fixing unit that heats a recording medium onto which an image obtained by visualizing an electrostatic latent image that is formed by writing an image on a latent image carrier is transferred, to fix the image on the recording medium, wherein the fixing unit includes a housing in which a heat source for heating a member to be heated is disposed, the housing includes a first end and a second end in a longitudinal direction, each of the first end and the second end being linked to a duct; and a blowing unit that is provided at the first end of the housing and causes an airflow in an internal space of the housing in which the heat source is disposed, wherein the duct linked to the second end of the housing is formed to extend from the second end, and a length of the duct linked to the second end of the housing is longer than a hydraulic diameter of the duct by a predetermined number of times or more.

9. The image forming apparatus according to claim 8, wherein the length of the duct linked to the second end is set to ten times or more of 4×average area of the duct/average sectional length of the duct.

10. The image forming apparatus according to claim 8, wherein the duct linked to the second end of the housing is formed to extend upwards from the second end.

11. An image forming apparatus comprising:

a latent image carrier on which an electrostatic latent image is formed;

a writing unit that writes an image on the latent image carrier to form the electrostatic latent image;

an image forming unit that visualizes the electrostatic latent image formed on the latent image carrier;

a first forced intake unit that introduces air into the writing unit;

a forced exhaust unit that is provided near a fixing unit that heats a recording medium with a heat source to fix an image on the recording medium, the forced exhaust unit exhausting the air to outside; and a second forced intake unit that is provided between the first forced intake unit and the forced exhaust unit, and introduces the air moving inside the image forming apparatus into the heat source of the fixing unit, wherein the writing unit, the image forming unit, and the fixing unit are arranged from an upstream side to a downstream side in a moving direction of the air taken into the writing unit by the first forced intake unit.

12. The image forming apparatus according to claim 11, wherein the writing unit includes an emission opening that leads a writing light to a position opposed to the image forming unit and through which the air moving from the writing unit is dischargeable.

13. The image forming apparatus according to claim 11, wherein a total intake volume of the first forced intake unit is set larger than a total exhaust volume of the forced exhaust unit.

14. The image forming apparatus according to claim 11, wherein a plurality of first forced intake units is provided, and the first forced intake units are arranged at both ends of the image forming apparatus in a direction perpendicular to the moving direction of the air introduced.

15. The image forming apparatus according to claim 11, wherein the second forced intake unit includes a sirocco fan.

16. The image forming apparatus according to claim 11, wherein the first forced intake unit includes an axial flow fan.

17. The image forming apparatus according to claim 11, wherein a total intake volume of the first forced intake unit is set larger than a sum of a total exhaust volume of the forced exhaust unit and an intake volume of the second forced intake unit.

18. The image forming apparatus according to claim 11, wherein the writing unit is capable of forming an electrostatic latent image corresponding to a color image having a plurality of colors, and the image forming unit is capable of forming the color image.

* * * * *